United States Patent [19]

Harada

[11] Patent Number: 4,647,934

[45] Date of Patent: Mar. 3, 1987

[54] MULTISTAGE EXTENSIBLE ROD ANTENNA

[75] Inventor: Jiro Harada, Tokyo, Japan

[73] Assignee: Harada Kogyo Kabushiki Kaisha, Tokyo, Japan

[21] Appl. No.: 723,853

[22] Filed: Apr. 16, 1985

[30] Foreign Application Priority Data

Apr. 20, 1984 [JP] Japan ..... 59-58074[U]

[51] Int. Cl.[4] ..... H01Q 1/10

[52] U.S. Cl. ..... 343/901; 343/715

[58] Field of Search ..... 343/901, 715, 889, 900

[56] References Cited

U.S. PATENT DOCUMENTS 2,481,823 9/1949 Cejka ..... 343/901 X 3,359,559 12/1967 Guinn ..... 343/901

4,118,708 10/1978 Lozar et al. ..... 343/901

*Primary Examiner*—Daniel M. Yasich

*Attorney, Agent, or Firm*—Koda and Androlia

[57] ABSTRACT

A multistage extensible rod antenna system including a plurality of conductive rods which have different diameters, respectively, and are connected in a freely slidable manner to each other. Each of the conductive rods is provided, along its inner circumferential wall of the upper end portion, with first and second stepped portions of different diameters. The first and second stepped portions hold a first collar and a second collar, respectively with an elastic sealing ring therebetween. The upper end face of each of the rods is formed into an engaging portion to keep the collar from slipping off. The multistage extensible rod antenna system thus structured creates less compressive force on the elastic sealing ring, prolonging the elasticity of the sealing ring and extending the service life of the multistage extensible rod antenna system.

1 Claim, 9 Drawing Figures

FIG.3
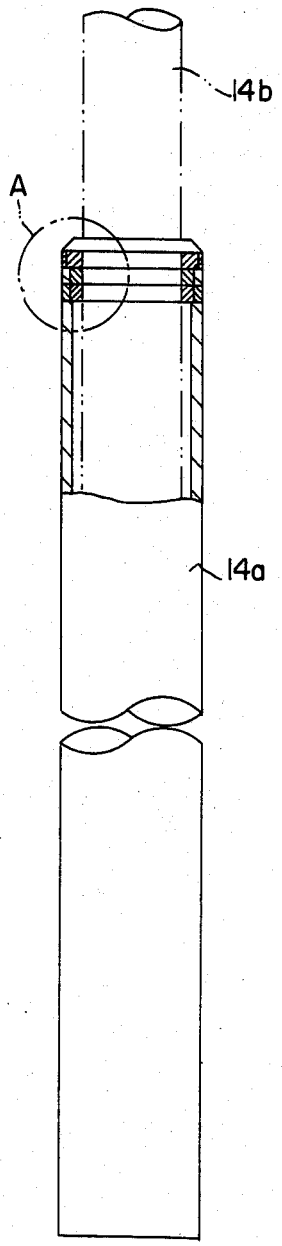
FIG. 4 (a)
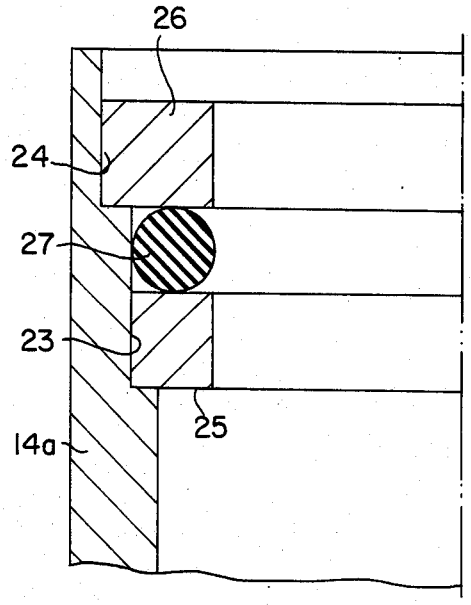
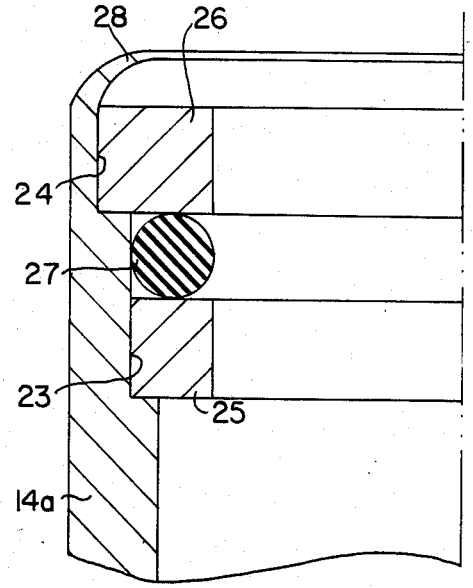
FIG. 4 (b)

FIG. 5
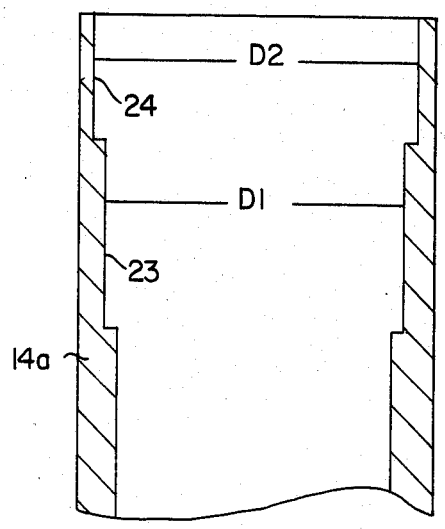
FIG. 6(a)
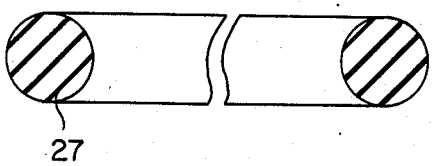
FIG. 6 (b)
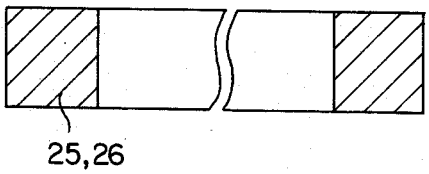
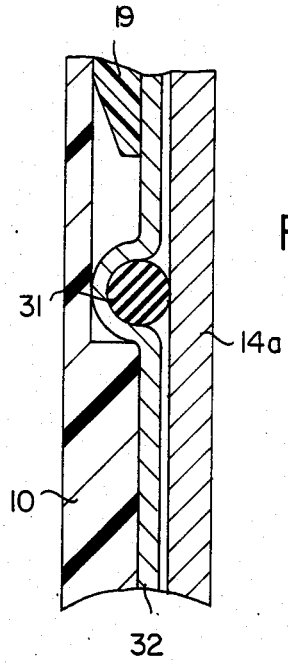
FIG. 7

MULTISTAGE EXTENSIBLE ROD ANTENNA

BACKGROUND OF THE INVENTION

1. Field of the Invention

The present invention relates to a rod antenna and more particularly to a multistage extensible rod antenna system for vehicles equipped with waterproof structure between the antenna rods.

2. Prior Art

In present multistage extensible rod antenna systems for vehicles such as automobiles, a stepped portion is formed at the upper end portion of the outside rod. An elastic sealing ring such as a conductive rubber O-ring, an insulating rubber 0-ring, etc., and collars made of "brass," etc. are fitted into the stepped portion. Then, by processing the end portion of the outside rod with caulking, these sealing rings and collars are press-fitted in order to prevent rain water, etc., from leaking through the interstage space between the outside rod and inside rod.

The foregoing waterproof structure, however, involves a potential risk. During caulking on the end portion of the outside rod, compressive force exceeding the elastic limit of the elastic sealing ring is likely to be applied to it through the collar. In particular, when there is a variation in the dimensions of the processed rod, it is more likely that even greater compressive force will be applied to the elastic sealing ring. If this occurs, the elastic sealing ring loses its elasticity, and the service life of the multistage extensible rod antenna element is drastically shortened.

SUMMARY OF THE INVENTION

The primary object of the present invention, therefore, is to provide a multistage extensible rod antenna system with a structure that reduces the loss of elasticity in the elastic sealings, thereby, extending the service life of the multistage extensible rod antenna element.

The abovementioned object of the present invention is accomplished by a unique structure for the multistage extensible rod antenna including a first stepped portion and a second stepped portion with different diameters which are formed in sequence along the inner circumferential wall of the upper end portion of each of the outside rods, a first collar and a second collar anchored to these first and second stepped portions, respectively, an elastic sealing ring fitted between the first and second collars, and an engaging portion for holding the collar from slipping off, the engaging portion being formed at the top end surface of each of the outside rods.

BRIEF DESCRIPTION OF THE DRAWINGS

FIG. 3 is a fragmentary sectional view showing a part of extracted rod antenna element;

FIGS. 4*a* and 4*b* are enlarged views of the circled portion A in FIG. 3;

FIG. 5 is a enlarged partial view of a conductive rod;

FIGS. 6*a* and 6*b* are sectional views of an elastic ring and collar, respectively; and FIG. 7 is an enlarged view of the circled portion B in FIG. 1.

DETAILED DESCRIPTION OF THE INVENTION

Figure 1:
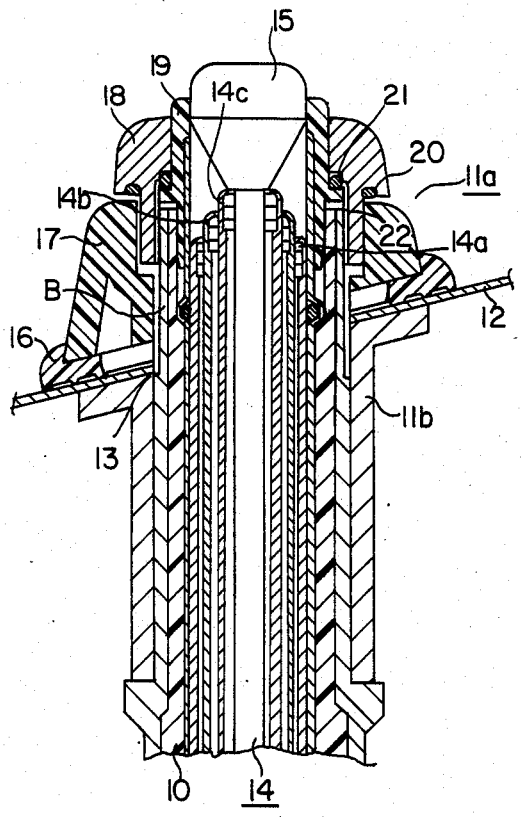
FIGS. 1 and 2 are longitudinal sectional views showing the structure of the antenna according to the present invention, sections at different portions of the antenna being illustrated, respectively.
Figure 2:
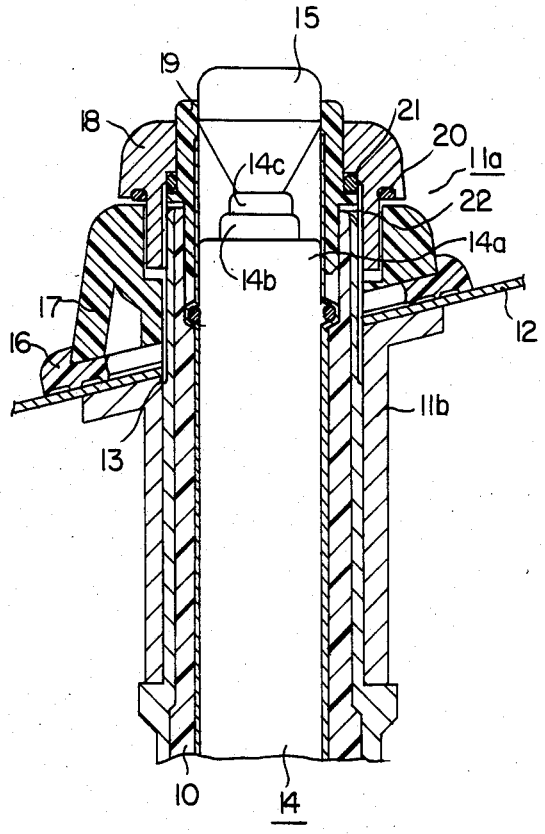

FIG. 1 and FIG. 2 are diagrams showing the structure of the antenna according to the present invention. These Figures are longitudinal sectional views showing the embodiment by sectioning the antenna at respectively different portions.

In FIGS. 1 and 2, the numeral 10 is a housing which accommodates an antenna element. The portion around the open end of this housing 10 is inserted into a fitting hole 13 formed in a vehicle wall 12 and fixed by means of an upper fitting member 11*a* and a lower fitting member 11*b*.

Inside of the housing, a multistage extensible rod antenna element 14 is provided. This antenna element 14 is formed of a plurality of conductive rods (three in this embodiment) with respectively different diameters, i.e. rod 14*a* (the largest diameter rod), 14*b* (the medium diameter rod), and rod 14*c* (the smallest diameter rod). These antenna rods are connected to each other in a known conventional manner to be freely slidable so that they can be extended and retracted.

At the top of the smallest diameter rod 14*c*, a top piece 15 is mounted. This top piece 15 serves as a decorative ball or a pick-up knob for extension of the antenna. The above mentioned upper fitting member 11*a* holds the housing 10 by clamping it with a nut 18 through a pad 16 and an insulator 17. Onto the inner circumferential wall of the nut 18, a rod insulator 19 is fitted. Furthermore, an O-ring 20, a waterproofing ring 21, and an O-ring 22 are tightly placed at respectively specified locations on the antenna rod.

FIG. 3 shows a section of a part of the multistage extensible rod antenna element 14. In particular, as seen in FIG. 5, along the inner circumferential wall of the upper end portion of the outside rod, for example, the largest diameter rod 14*a*, a first stepped portion 23 and a second stepped portion 24 with different diameters are formed in sequence. The first and second stepped portions 23 and 24 are designed to have diameters D1 and D2, respectively, and the relationship between the two diameters is set to be $D1<D2$ by setting the diameters of the circumferential walls of the first and second stepped portions 23 and 24 to be D1 and D2, respectively.

Further, as shown in FIG. 4 (*a*), to the first and second stepped portions 23 and 24, a first collar 25 and a second collar 26 which are both made of "brass," etc., are anchored, respectively. Also, between the first and second collars 25 and 26, an elastic sealing ring 27, such as a conductive rubber O-ring, is fitted and seated. Furthermore, as shown in FIG. 4 (*b*), the upper end face of the largest diameter rod 14*a* is formed into an engaging portion 28 by the caulking for holding the collars from slipping off (an anti-collar slipping portion). As a result, the second collar 26 which is anchored to the second stepped portion 24 is prevented from slipping off when the inside rod, for example, the rod 14*b*, is extended or retracted.

FIG. 7 is an enlarged view of the portion B of FIG. 1. In the Figure, an O-ring 13, inserted into the housing 10, functions to effect the waterproofing for the space between the largest diameter rod 14*a* and the housing 10. The numeral 32 is a metal pipe fitted onto the inner circumferential wall of the housing 10 so as to be a single body with the housing 10.

In the multistage extensible rod antenna system having the above-described structure, the elastic sealing ring 27 tightly contacts the outer circumferential wall of the inside rod. Therefore, there is no potential danger of the rain water, etc. leaking into the system through the interstage space of the conductive rods, i.e. through the space between the outside rod and the inside rod.

Further, because the O-ring 31 is kept in close contact with the outer circumferential surface of the largest diameter rod 14*a*, rain water, etc. does not leak in through the space between the largest diameter rod 14*a* and the housing 10. Furthermore, since the collar 26 is engaged with the stepped portion 24, no excessively strong compressive force is applied to the elastic sealing ring 27 during caulking of the end of the outside rod. As a result, the elasticity of the elastic sealing ring 27 can be extended, and this in turn brings about extended service life of the multistage extensible antenna element 14.

In addition, since the elastic ring 27 is made of conductive rubber, a boosting of the interstage conductivity between the respective rod also can be obtained. Besides, compared with conventional antenna systems of this type, the only extra work required for this embodiment is counter boring on the first and second stepped portions 23 and 24. Therefore, the manufacturing cost for this multistage extensible rod antenna system according to the present invention is not substantially increased.

The present invention is not limited to the embodiment shown above. For example, in the previous embodiment, the elastic ring 27 is made of conductive rubber, but it may be made of insulating rubber. Also, many modifications and variations of the present invention are possible in light of the above teachings. It should, therefore, be understood that within the appended claim, the invention may be practiced otherwise than as specifically described.

As should be apparent from the description given above, in the multistage extensible rod antenna system according to the present invention, first and second stepped portions with respectively different diameters are formed in sequence along the inner circumferential wall of the upper end portion of each of the outside rods; to these first and second stepped portions, first and second collars for holding the elastic sealing ring that is fitted between the foregoing first and second collars are provided and engaging portions to prevent the collars from slipping off are formed at the upper end face of each of the outside rods.

Consequently, the multistage extensible rod antenna system's elastic sealing ring in the form of, for example, a conductive rubber O-ring or an insulating rubber O-ring, does not lose its elasticity and has a longer service life.

I claim:

1. A multistage extensible rod antenna system comprsing:

a multistage extensible rod antenna element including a plurality of conductive rods with respectively different diameters, the conductive rods being connected to each other in a freely slidable manner;

first and second stepped portions of different diameters, the diameter of the first step portion being larger than the diameter of the second step portion, the first and second stepped portions further being formed spaced apart a predetermined distance from each other towards the top on the inner circumferential wall in the upper end portion of each of the plurality of conductive rods;

first and second collars fitted into the first and second stepped portions, respectively, said first collar having a larger outside diameter than said second collar;

an elastic sealing ring fitted between the first and second collars; and an engaging portion for preventing the collar from slipping off, the engaging portion being formed at the upper end face of each of the plurality of conductive rods.

* * * * *